US009861187B2

(12) United States Patent
Zimmerman

(10) Patent No.: US 9,861,187 B2
(45) Date of Patent: Jan. 9, 2018

(54) SELF-RIGHTING TOOTHBRUSH

(71) Applicant: Israel Harry Zimmerman, Los Angeles, CA (US)

(72) Inventor: Israel Harry Zimmerman, Los Angeles, CA (US)

( * ) Notice: Subject to any disclaimer, the term of this patent is extended or adjusted under 35 U.S.C. 154(b) by 271 days.

(21) Appl. No.: 14/856,166

(22) Filed: Sep. 16, 2015

(65) Prior Publication Data

US 2017/0071322 A1 Mar. 16, 2017

(51) Int. Cl.

| | |
|---|---|
| ***A46B 9/04*** | (2006.01) |
| ***A46B 5/00*** | (2006.01) |
| ***B25G 1/06*** | (2006.01) |
| ***A46B 15/00*** | (2006.01) |

(52) U.S. Cl.

CPC ..... *A46B 5/0054* (2013.01); *A46B 9/04* (2013.01); *A46B 15/0097* (2013.01); *B25G 1/06* (2013.01); *A46B 2200/1066* (2013.01)

(58) Field of Classification Search

CPC ..... A46B 15/0097; A46B 9/04; A46B 2200/1066; A46B 5/0054; B25G 1/06

See application file for complete search history.

(56) References Cited

U.S. PATENT DOCUMENTS

| | | | | |
|---|---|---|---|---|
| 2,722,703 | A | 11/1955 | Green | |
| 3,968,950 | A | 7/1976 | Gallo | |
| 5,517,713 | A * | 5/1996 | Hadcock | A46B 5/02 15/143.1 |
| 5,860,190 | A | 1/1999 | Cano | |
| 5,956,796 | A | 9/1999 | Lodato | |
| 6,490,760 | B1 | 12/2002 | Lauer et al. | |
| 7,007,335 | B1 | 3/2006 | Doat | |
| 7,527,446 | B2 | 5/2009 | Johnson Papa et al. | |
| 8,650,697 | B2 | 2/2014 | Lombardi | |

(Continued)

FOREIGN PATENT DOCUMENTS

| | | | | |
|---|---|---|---|---|
| CH | 703696 | A2 * | 3/2012 | A46B 5/02 |
| DE | 202011002076 | U1 | 9/2011 | |
| GB | 2443888 | A | 5/2008 | |

OTHER PUBLICATIONS

S. Mayo, Basics of IEPE accelerometers, Meggitt Sensing Systems, Feb. 2013, 11 pages.

(Continued)

*Primary Examiner* — Laura C Guidotti
(74) *Attorney, Agent, or Firm* — Walter W. Duft

(57) ABSTRACT

A self-righting toothbrush includes a medial section disposed between head and tail sections. The head section mounts a set of frontwardly extending bristles. The tail section has a rearwardly extending asymmetry. The medial section has a pivot surface whose center of rotation defines a pivot point on a longitudinal neutral pivot axis. The pivot surface allows the toothbrush to pivot about the neutral pivot axis when the toothbrush is placed on a support surface. The head and tail sections have respective centers of mass. In a non-bristles up position, the head and tail section centers of mass are spaced from the neutral pivot axis on opposite sides thereof. Due to a moment imbalance dominated by the tail section center of mass, there is a net rotational moment about the neutral pivot axis that induces the toothbrush to pivot about the neutral pivot axis to a bristles up position.

28 Claims, 3 Drawing Sheets

(56) References Cited

U.S. PATENT DOCUMENTS

| | | | | |
|---|---|---|---|---|
| 8,769,832 | B1 | 7/2014 | Joyner | |
| 2007/0039109 | A1 | 2/2007 | Nanda | |
| 2008/0311282 | A1* | 12/2008 | Hammon | A46B 5/00 427/2.29 |

OTHER PUBLICATIONS

Wilcoxon Research, Piezoelectric accelerometer design, Meggit Sensing Systems, May 2009, 42 pages.

* cited by examiner

SELF-RIGHTING TOOTHBRUSH

BACKGROUND

1. Field

The present disclosure relates to toothbrush technology. More particularly, the disclosure is directed to improvements in toothbrush sanitation.

2. Description of the Prior Art

By way of background, toothbrushes have become evergreen products and a vital tool necessary for oral health. At the same time, given the environment that brushes are used in, cleanliness is a crucial element of safe use. It is well known that the mouth, and the gums in particular are efficient portals for transporting bacteria through the body, which is why some people with certain health issues are required to take antibiotics prior to certain dental procedures.

The standard toothbrush has an elongated shaft with bristles attached to one end and the other end forming a handle. In a typical bathroom environment, a toothbrush is often placed on surfaces that harbor bacteria and other microorganisms, such as on a counter top next to a sink, on a shelf in a medicine cabinet, in a drawer, etc. Unless the toothbrush is placed on the surface with the bristles are facing up, the bristles can contact the surface and any microorganisms that may be present thereon can transfer to the bristles and subsequently enter the mouth. Notwithstanding the foregoing, toothbrush users at one time or another have placed their toothbrushes onto counter tops where the bristle end of the toothbrush is either are laid on its side or face down. This is particularly pronounced with younger children that may not be as cognizant of hygienic protocol.

It is to improvements in toothbrush sanitation that the present disclosure is directed. In particular, a self-righting toothbrush is disclosed that is configured to pivot to a bristles up position in most instances when the toothbrush is dropped or placed onto a surface.

SUMMARY

A self-righting toothbrush includes a head section, a tail section and a medial section. The medial section is disposed between the head section and the tail section in a longitudinal direction of the toothbrush. The head section mounts a set of bristles that extend in a frontward direction. The tail section has a lateral asymmetry that extends in a rearward direction that is generally opposite to the frontward direction. The medial section has a pivot surface whose center of rotation defines a pivot point lying on a neutral pivot axis extending generally in the longitudinal direction. The pivot surface is configured to contact a support surface when the toothbrush is placed on the support surface. The pivot surface allows the toothbrush to undergo pivoting about the neutral pivot axis.

The head section and the tail section have a respective head section center of mass and a tail section center of mass. When the toothbrush is in a bristles up position in which the bristles extend generally away from the support surface, the head section center of mass and the tail section center of mass are substantially vertically aligned with the neutral pivot axis in a stable orientation. When the toothbrush is in a non-bristles up position, such as when the bristles are oriented generally horizontally, the head section center of mass and the tail section of mass assume non-neutral positions spaced from the neutral pivot axis and on opposite sides thereof. The non-neutral positions of the head section center of mass and the tail section center of mass produce respective rotational moments that are in opposition to each other. The rotational moment produced by the tail section center of mass is dominant so as to create a net rotational moment about the neutral pivot axis that tends to induce the toothbrush to pivot about the neutral pivot axis to the bristles up position.

In one aspect, the toothbrush is configured with a head-down bias in which the head section touches the support surface and the tail section does not contact the support surface after the toothbrush comes to rest in the bristles up position. The head-down bias may also exist during pivoting of the toothbrush about the neutral pivot axis.

In another aspect, the toothbrush is configured with a tail-down bias in which the tail section touches the support surface and the head section does not contact the support surface after the toothbrush comes to rest in the bristles up position. The tail-down bias does not exist during pivoting of the toothbrush about the neutral pivot axis so as not to interfere with the pivoting.

In a further aspect, the toothbrush is configured with a neutral bias in which neither the head section nor the tail section touches the support surface after the toothbrush comes to rest in the bristles up position. The neutral bias may also exist during pivoting of the toothbrush about the neutral pivot axis.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Figure 1:
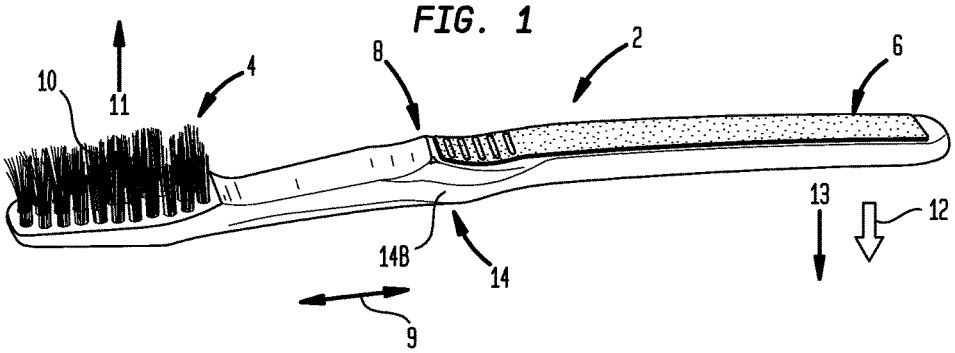
FIG. 1 is a perspective view showing an example embodiment of a self-righting toothbrush that may be constructed in accordance with the present disclosure.

Turning now to the drawing figures, in which like reference numbers illustrate like structure in all of the several views, FIGS. 1-4 illustrate an example embodiment of a bristle-isolating toothbrush 2 having a head section 4, a tail section 6, and a medial section 8. The medial section 8 is disposed between the head section 4 and the tail section 6 in a longitudinal direction 9 of the toothbrush 2. The base of the head section 4 mounts a set of bristles 10. Unless otherwise indicated, the materials used to fabricate the toothbrush 2 are the same as may be found in conventional toothbrushes, which are mainly plastics such as polypropylene or polyethylene for the rigid non-bristle component(s), and Nylon for the bristles.

Figure 2:
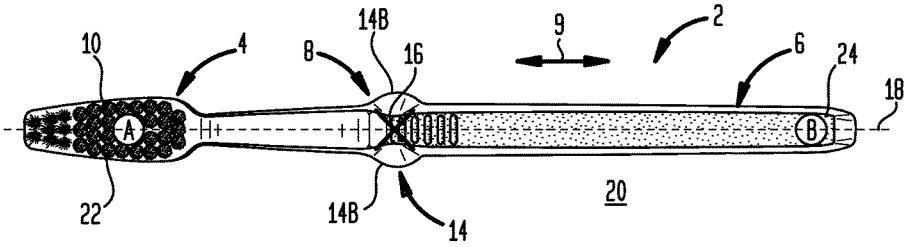
FIG. 2 is a plan view showing the front of the toothbrush of FIG. 1 with the rear of the toothbrush resting on a support surface in a bristles up position.
Figure 3:
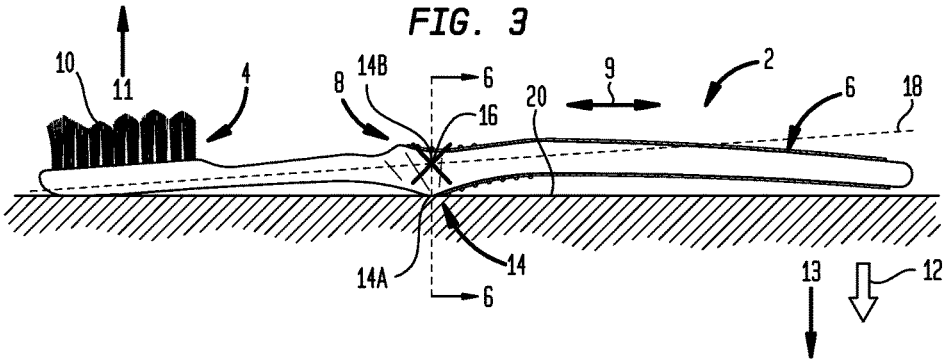
FIG. 3 is a side view of the toothbrush of FIG. 1 with the toothbrush positioned as in FIG. 2 with the rear of the toothbrush resting on a support surface in a bristles up position.
Figure 4:
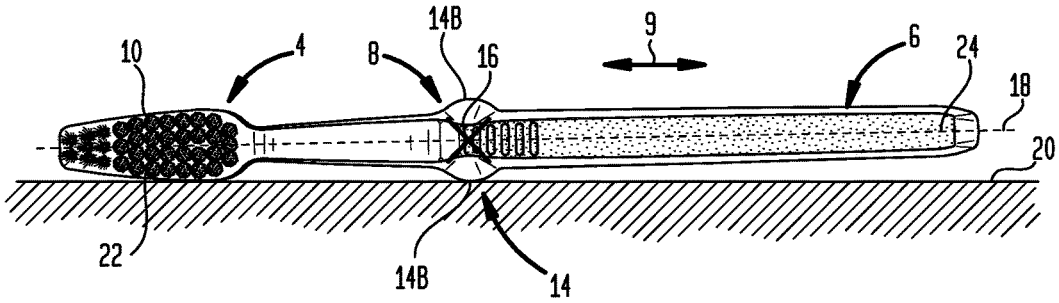
FIG. 4 is a side view of the toothbrush of FIG. 1 with a side edge of the toothbrush resting on a support surface in a non-bristles up position.
Figure 5:
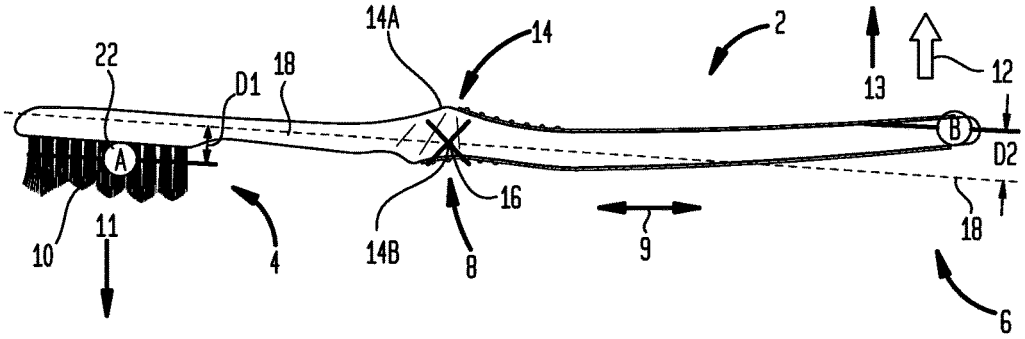
FIG. 5 is a plan view of the toothbrush of FIG. 1 positioned as in FIG. 4 with a side edge of the toothbrush resting on a support surface in a non-bristles up position.

As can be seen in FIGS. 1, 3 and 5, the bristles 10 extend in a frontward direction 11 of the toothbrush 2, starting from their point of attachment to the head section 4. The tail section 6 has a lateral asymmetry 12 that extends in a rearward direction 13 of the toothbrush 2, which is generally opposite to the frontward direction. The medial section 8 has a pivot surface 14 whose center of rotation defines a pivot point 16 (see FIGS. 2-5) lying on a neutral pivot axis 18 of the toothbrush 2 that extends generally in the elongated longitudinal direction 9 of the toothbrush. The pivot surface 14 is configured to contact a support surface 20 (see FIGS. 3 and 4) when the toothbrush 2 is placed on the support surface. As described in more detail below, the pivot surface 14 allows the toothbrush 2 to undergo pivoting about the neutral pivot axis 18.

Figure 6:
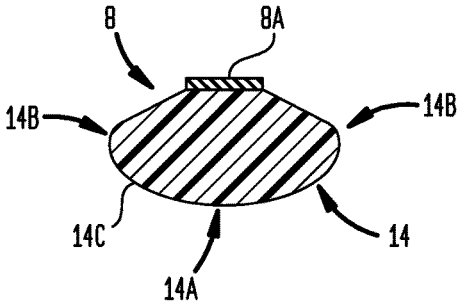
FIG. 6 is a cross-sectional view taken along line 6-6 in FIG. 3 through the medial section of the toothbrush of FIG. 1.

In the disclosed embodiments, the pivot surface 14 may include a rearward protrusion 14A (see FIGS. 2, 3 and 4) and two lateral protrusion 14B, one on each side of the rearward protrusion. As shown in FIG. 6, the pivot surface 14 preferably has a continuous curve 14C of selected shape (e.g., circular, oval, etc.) that extends between the lateral sections 14B, and through the rearward section 14A. This aids in pivoting the toothbrush 2 about the neutral pivot axis 18. If desired, the pivot surface 14 may terminate at the lateral protrusions 14B. The range of pivoting will be lie between positions in which the toothbrush 2 is oriented in a non-bristles up position, with the bristles 10 extending generally horizontally and parallel to the support surface 20. FIG. 4 represents one such position. The second such position would be with the toothbrush 2 pivoted 180° from the position shown in FIG. 4. The midpoint of the pivot range is a bristles up position in which the bristles 10 extend generally away from the support surface and the tail section lateral asymmetry 12 extends toward the support surface, as shown in FIG. 3.

As shown in FIG. 6, the front side of the medial section 8 may angle toward a flat front surface that may be ridged to provide a thumb grip 8A of the toothbrush 2. It will be appreciated that without a pivot surface on the front side of the medial section 8, the toothbrush 2 will not naturally pivot from a strictly bristles down position in which the bristles extend directly toward the support surface 20. In this position, the ends of the bristles 10 will rest on the support surface 20 as a first point of contact, and a second point of contact will be somewhere along the front side of the tail section 6. The medial section 8 will have no contact with the support surface 20, such that pivoting is effectively prevented. This is advantageous in that 360 degree pivoting, which could cause the toothbrush 2 to roll off the support surface 20, is prevented. On the other hand, if it is desired to extend the range of pivoting toward and possibly including the bristles down position, the pivot surface 14 may be extended to include some or all of the front side of the medial section 8. It should be noted that for the bristles up position, stability and resistance to 360 degree rolling is provided by the somewhat flattened surface contour 14C near the midpoint of the rearward protrusion 14A. Further flattening of the rearward protrusion 14A would add additional stability.

As shown in FIGS. 2 and 5, the head section 4 and the tail section 6 have a respective head section center of mass 22 (Mass "A") and a tail section center of mass 24 (Mass "B"). When the toothbrush 2 is in a bristles up position, as shown in FIG. 2, the head section center of mass 22 and the tail section center of mass 24 are substantially vertically aligned with the neutral pivot axis 18 in a stable non-pivoting orientation. When the toothbrush 2 is in a non-bristles up position, such as when the bristles are oriented generally horizontally as shown in FIG. 5, the head section center of mass 22 and the tail section center of mass 24 assume non-neutral positions spaced from the neutral pivot axis and on opposite sides thereof. In FIG. 5, the head section center of mass 22 is spaced from the neutral pivot axis 18 on a first side thereof by a distance "D1." The tail section center of mass 24 is spaced from the neutral pivot axis 18 on a second side thereof by a distance "D2."

The non-neutral positions of the head section center of mass 22 and the tail section center of mass shown in FIG. 5 produce respective rotational moments that are in opposition to each other. A head section rotational moment (MomentA), which equals MassA×D1, urges the toothbrush 2 to pivot toward a bristles down position in which the bristles 10 extend generally toward the support surface 20. A tail section rotational moment (MomentB), which equals MassB×D2, urges the toothbrush to pivot toward a bristles up position. By designing the toothbrush 2 so that MomentB is larger than MomentA, a moment differential or imbalance is created that results in a net rotational moment (MomentNet) dominated by MomentB. MomentNet tends to induce the toothbrush 2 to pivot about the neutral pivot axis 18 to a bristles up position in which the bristles 10 extend generally away from the support surface 20.

Designing the toothbrush 2 to produce a net rotational moment that induces pivoting to a bristles up position may be implemented by controlling the size and/or location of head section center of mass 22 and the tail section center of mass 24. The net moment may be provided at least in part by spacing the tail section center of mass 24 further from the neutral pivot axis 18 than the head section center of mass 22. Alternatively, or in addition, the net moment may be provided at least in part by making the tail section center of mass 24 heavier than the head section center of mass 22.

The non-neutral location of the head section center of mass 22 in FIG. 5 is due largely to the weight of the bristles extending in the frontward direction 11 from their point of attachment to the base of the head section 4. The location and weight of the head section center of mass 22 may thus be varied according to the size and weight of the bristles 10. The angle of the head section 4 is also a factor. In FIG. 5, the head section 4 is substantially aligned with the neutral pivot axis 18. It will be appreciated that shifting the head section 4 rearwardly or forwardly would shift the head section center of mass 22 toward or away from the neutral pivot axis 18, thereby varying the head section MomentA.

The non-neutral location of the tail section center of mass 24 is due to the lateral asymmetry 12 of the tail section 6. It will be appreciated that the tail section lateral asymmetry may be provided in various ways. For example, the asymmetry may include some or all of the tail section 6 being angled or curved rearwardly away from the neutral pivot axis 18. Other configurations would also be possible. As shown in FIG. 5, the portion of the tail section 6 that merges with the medial section 8 may be situated on the neutral pivot axis or even extend frontwardly thereof. This is permissible so long as some other portion of the tail section 6, such as its terminal end thereof, extends rearwardly from the neutral pivot axis, as shown in FIG. 5. Changing the weight of the tail section 6 is another way to adjust the tail section MomentB. This could be accomplished in various ways, such as using a different (e.g., more dense) material, adding ballast, etc.

A further design consideration for the toothbrush 2 is the positioning of its head and tail sections 4 and 6 relative to the support surface 20 when the toothbrush is resting on the support surface. In FIG. 3, the toothbrush 2 is configured with a head-down bias in which the head section 4 touches the support surface 20 after the toothbrush comes to rest in the bristles up position. As shown in FIG. 4, the toothbrush 2 the head-down bias may also exist during pivoting of the toothbrush about the neutral pivot axis 18. The tail section 6 preferably does not contact the support surface 20 during pivoting (such that pivoting is not restricted) but may come in contact therewith as the toothbrush 2 reaches the bristles up position.

Figure 7:
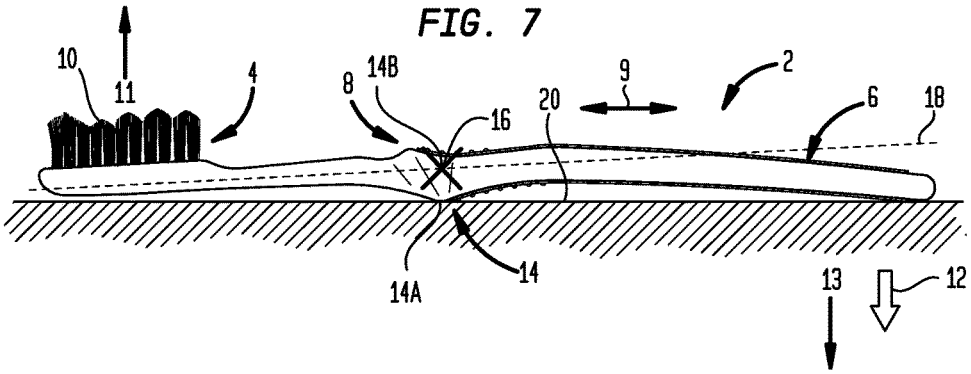
FIG. 7 is a side view of the toothbrush of FIG. 1 with the rear of the toothbrush resting on a support surface in a bristles up position, and with the toothbrush configured with a tail-down bias.

In another aspect, shown in FIG. 7, the toothbrush 2 may be configured with a tail-down bias in which the tail section touches the support surface and the head section does not contact the support surface after the toothbrush comes to rest in the bristles up position. As in the configuration of FIG. 5, the tail-down bias does not exist during pivoting of the toothbrush about the neutral pivot axis so as not to interfere with the pivoting.

Figure 8:
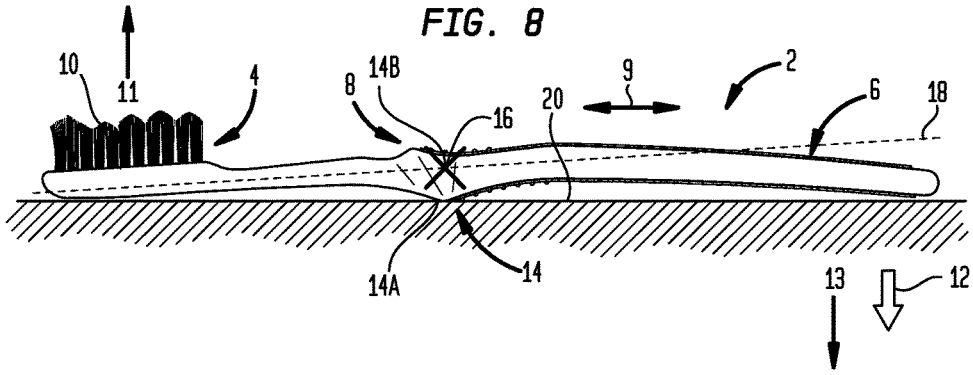
FIG. 8 is a side view of the toothbrush of FIG. 1 with the rear of the toothbrush resting on a support surface in a bristles up position, and with the toothbrush configured with a neutral bias.
Figure 9:
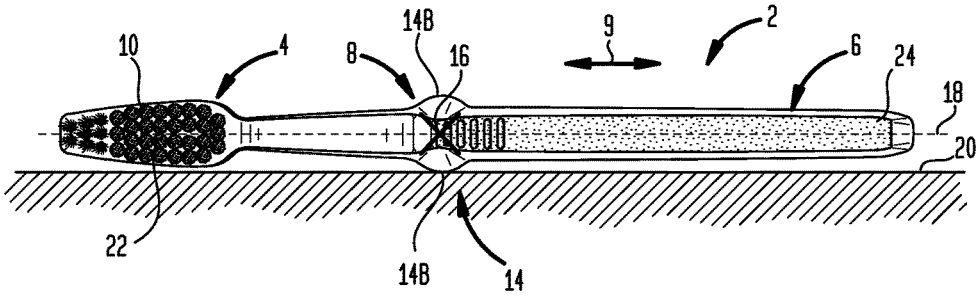
FIG. 9 is a side view of the toothbrush of FIG. 1 with a side edge of the toothbrush resting on a support surface in a non-bristles up position; and with the toothbrush configured with a neutral bias.

In a further aspect, shown in FIG. 8, the toothbrush 2 may be configured with a neutral bias in which neither the head section nor the tail section touches the support surface after the toothbrush comes to rest in the bristles up position. The neutral bias may also exist during pivoting of the toothbrush about the neutral pivot axis, as shown in FIG. 9.

Accordingly, a self-righting toothbrush 2 has been disclosed. The self-righting feature naturally pivots the toothbrush 2 to its bristles up position. This isolates the bristles 10 from the support surface 20 in most instances when the toothbrush is dropped or placed onto the support surface. The toothbrush 2 does so by harnessing the benefits of rotational inertia by utilizing the formula W (weight) times A (arm) equals Moment, the same basic formula used for aircraft balancing. The toothbrush 2 utilizes the foregoing formula to provide a design that will naturally only be at an equilibrium state with the toothbrush resting generally in the bristles up position.

Advantageously, the toothbrush 2 has the appearance of a traditional toothbrush and can be designed to fit into any traditional toothbrush holder. In addition, there is no learning curve to it use. As the toothbrush 2 is placed or even tossed on the support surface 20, it will automatically self orient itself into the desired bristles up position.

Although example embodiments of the disclosed subject matter have been shown and described, it should be apparent that many variations and alternative embodiments could be implemented in accordance with the present disclosure. It is understood, therefore, that the invention is not to be in any way limited except in accordance with the spirit of the appended claims and their equivalents.

What is claimed is:

1. A self-righting toothbrush, comprising:

a head section, a tail section and a medial section, said medial section being disposed between said head section and said tail section in a longitudinal direction of said toothbrush;

said head section mounting a set of bristles that extend in a frontward direction;

said tail section having a lateral asymmetry that extends in a rearward direction that is generally opposite to said frontward direction;

said medial section having a pivot surface whose center of rotation defines a pivot point lying on a neutral pivot axis extending generally in said longitudinal direction, said pivot surface being configured to contact a support surface when said toothbrush is placed on said support surface, said pivot surface allowing said toothbrush to undergo pivoting about said neutral pivot axis;

said head section and said tail section having a respective head section center of mass and a tail section center of mass;

said head section center of mass and said tail section center of mass being substantially vertically aligned with said neutral pivot axis in a stable orientation when said toothbrush is in a bristles up position in which said bristles extend generally away from said support surface;

said head section center of mass and said tail section center of mass assuming non-neutral positions spaced from said neutral pivot axis and on opposite sides thereof when said toothbrush is in a non-bristles up position;

said non-neutral positions of said head section center of mass and said tail section center of mass producing respective rotational moments that are in opposition to each other, with said rotational moment produced by said tail section center of mass being dominant so as to create a net rotational moment about said neutral pivot axis that tends to induce said toothbrush to pivot about said neutral pivot axis to said bristles up position; and said toothbrush being configured with a head-down bias wherein said head section touches said support surface and said tail section does not contact said support surface after said toothbrush comes to rest in said bristles up position.

2. The toothbrush of claim 1, wherein said head-down bias also exists when said toothbrush pivots about said neutral pivot axis.

3. The toothbrush of claim 1, wherein said net moment is due at least in part to said tail section center of mass being further from said neutral pivot axis than said head section center of mass.

4. The toothbrush of claim 1, wherein said net moment is due at least in part to a tail section mass, which is centered around said tail section center of mass, being larger than a head section mass, which is centered around said head section center of mass.

5. The toothbrush of claim 1, wherein said tail section lateral asymmetry comprises said tail section being angled or curved away from said neutral pivot axis.

6. The toothbrush of claim 1, wherein said pivot surface comprises a rearward protrusion and a lateral protrusion on each side of said rearward protrusion, said rearward protrusion and said lateral protrusions forming a continuous curve of selected shape.

7. The toothbrush of claim 6, wherein said pivot surface terminates at said lateral protrusions, and wherein said medial section has no pivot surface that would allow said toothbrush to pivot from a strictly bristles down position in which said bristles extend directly toward said support surface.

8. A self-righting toothbrush, comprising:

a head section, a tail section and a medial section, said medial section being disposed between said head section and said tail section in a longitudinal direction of said toothbrush;

said head section mounting a set of bristles that extend in a frontward direction;

said tail section having a lateral asymmetry that extends in a rearward direction that is generally opposite to said frontward direction;

said medial section having a pivot surface whose center of rotation defines a pivot point lying on a neutral pivot axis extending generally in said longitudinal direction, said pivot surface being configured to contact a support surface when said toothbrush is placed on said support surface, said pivot surface allowing said toothbrush to undergo pivoting about said neutral pivot axis;

said head section and said tail section having a respective head section center of mass and a tail section center of mass;

said head section center of mass and said tail section center of mass being substantially vertically aligned with said neutral pivot axis in a stable orientation when said toothbrush is in a bristles up position in which said bristles extend generally away from said support surface;

said head section center of mass and said tail section center of mass assuming non-neutral positions spaced from said neutral pivot axis and on opposite sides thereof when said toothbrush is in a non-bristles up position;

said non-neutral positions of said head section center of mass and said tail section center of mass producing respective rotational moments that are in opposition to each other, with said rotational moment produced by said tail section center of mass being dominant so as to create a net rotational moment about said neutral pivot axis that tends to induce said toothbrush to pivot about said neutral pivot axis to said bristles up position; and said toothbrush being configured with a tail-down bias wherein said tail section touches said support surface and said head section does not contact said support surface after said toothbrush comes to rest in said bristles up position.

9. The toothbrush of claim 8, wherein said tail-down bias does not exist when said toothbrush pivots about said neutral pivot axis.

10. The toothbrush of claim 8, wherein said net moment is due at least in part to said tail section center of mass being further from said neutral pivot axis than said head section center of mass.

11. The toothbrush of claim 8, wherein said net moment is due at least in part to a tail section mass, which is centered around said tail section center of mass, being larger than a head section mass, which is centered around said head section center of mass.

12. The toothbrush of claim 8, wherein said tail section lateral asymmetry comprises said tail section being angled or curved away from said neutral pivot axis.

13. The toothbrush of claim 8, wherein said pivot surface comprises a rearward protrusion and a lateral protrusion on each side of said rearward protrusion, said rearward protrusion and said lateral protrusions forming a continuous curve of selected shape.

14. The toothbrush of claim 13, wherein said pivot surface terminates at said lateral protrusions, and wherein said medial section has no pivot surface that would allow said toothbrush to pivot from a strictly bristles down position in which said bristles extend directly toward said support surface.

15. A self-righting toothbrush, comprising:

a head section, a tail section and a medial section, said medial section being disposed between said head section and said tail section in a longitudinal direction of said toothbrush;

said head section mounting a set of bristles that extend in a frontward direction;

said tail section having a lateral asymmetry that extends in a rearward direction that is generally opposite to said frontward direction;

said medial section having a pivot surface whose center of rotation defines a pivot point lying on a neutral pivot axis extending generally in said longitudinal direction, said pivot surface being configured to contact a support surface when said toothbrush is placed on said support surface, said pivot surface allowing said toothbrush to undergo pivoting about said neutral pivot axis;

said head section and said tail section having a respective head section center of mass and a tail section center of mass;

said head section center of mass and said tail section center of mass being substantially vertically aligned with said neutral pivot axis in a stable orientation when said toothbrush is in a bristles up position in which said bristles extend generally away from said support surface;

said head section center of mass and said tail section center of mass assuming non-neutral positions spaced from said neutral pivot axis and on opposite sides thereof when said toothbrush is in a non-bristles up position;

said non-neutral positions of said head section center of mass and said tail section center of mass producing respective rotational moments that are in opposition to each other, with said rotational moment produced by said tail section center of mass being dominant so as to create a net rotational moment about said neutral pivot axis that tends to induce said toothbrush to pivot about said neutral pivot axis to said bristles up position; and said toothbrush being configured with a neutral bias wherein said neither said head section nor said tail section touches said support surface after said toothbrush comes to rest said bristles up position.

16. The toothbrush of claim 15, wherein said neutral bias also exists when said toothbrush pivots about said neutral axis.

17. The toothbrush of claim 15, wherein said net moment is due at least in part to said tail section center of mass being further from said neutral pivot axis than said head section center of mass.

18. The toothbrush of claim 15, wherein said net moment is due at least in part to a tail section mass, which is centered around said tail section center of mass, being larger than a head section mass, which is centered around said head section center of mass.

19. The toothbrush of claim 15, wherein said tail section lateral asymmetry comprises said tail section being angled or curved away from said neutral pivot axis.

20. The toothbrush of claim 15, wherein said pivot surface comprises a rearward protrusion and a lateral protrusion on each side of said rearward protrusion, said rearward protrusion and said lateral protrusions forming a continuous curve of selected shape, said pivot surface terminating at said lateral protrusions such that said medial section has no pivot surface that would allow said toothbrush to pivot from a strictly bristles down position in which said bristles extend directly toward said support surface.

21. A self-righting toothbrush, comprising:

a head section, a tail section and a medial section, said medial section being disposed between said head section and said tail section in a longitudinal direction of said toothbrush;

said head section mounting a set of bristles that extend in a frontward direction;

said tail section having a lateral asymmetry that extends in a rearward direction that is generally opposite to said frontward direction;

said medial section having a pivot surface whose center of rotation defines a pivot point lying on a neutral pivot axis extending generally in said longitudinal direction, said pivot surface being configured to contact a support surface when said toothbrush is placed on said support surface, said pivot surface allowing said toothbrush to undergo pivoting about said neutral pivot axis;

said head section and said tail section having a respective head section center of mass and a tail section center of mass;

said head section center of mass and said tail section center of mass being substantially vertically aligned with said neutral pivot axis in a stable orientation when said toothbrush is in a bristles up position in which said bristles extend generally away from said support surface;

said head section center of mass and said tail section center of mass assuming non-neutral positions spaced from said neutral pivot axis and on opposite sides thereof when said toothbrush is in a non-bristles up position; and said non-neutral positions of said head section center of mass and said tail section center of mass producing respective rotational moments that are in opposition to each other, with said rotational moment produced by said tail section center of mass being dominant so as to create a net rotational moment about said neutral pivot axis that tends to induce said toothbrush to pivot about said neutral pivot axis to said bristles up position.

22. The toothbrush of claim 21, wherein said net moment is due at least in part to said tail section center of mass being further from said neutral pivot axis than said head section center of mass.

23. The toothbrush of claim 21, wherein said net moment is due at least in part to a tail section mass centered around said tail section center of mass being larger than a head section mass centered around said head section center of mass.

24. The toothbrush of claim 21, wherein said tail section lateral asymmetry comprises said tail section being angled or curved away from said neutral pivot axis.

25. The toothbrush of claim 21, wherein said pivot surface comprises a rearward protrusion and a lateral protrusion on each side of said rearward protrusion, said rearward protrusion and said lateral protrusions forming a continuous curve of selected shape.

26. The toothbrush of claim 25, wherein said pivot surface terminates at said lateral protrusions, and wherein said medial section has no pivot surface that would allow said toothbrush to pivot from a strictly bristles down position in which said bristles extend directly toward said support surface.

27. The toothbrush of claim 25, wherein pivot surface extends beyond said lateral protrusions to include some or all of a front side of said medial section.

28. The toothbrush of claim 25, wherein said pivot surface comprises a flattened surface contour proximate to a midpoint of said rearward protrusion, said flattened surface contour contacting said support surface when said toothbrush is in said bristles up position to provide stability in said bristles up position and resistance to 360 degree rolling.

* * * * *